US008253005B2

(12) United States Patent
Asami

(10) Patent No.: US 8,253,005 B2
(45) Date of Patent: Aug. 28, 2012

(54) SELECTING DEVICE, SELECTING METHOD, AND INFORMATION RECORDING MEDIUM

(75) Inventor: Yuichi Asami, Minato-ku (JP)

(73) Assignee: Konami Digital Entertainment Co., Ltd., Minato-ku, Tokyo (JP)

( * ) Notice: Subject to any disclaimer, the term of this patent is extended or adjusted under 35 U.S.C. 154(b) by 85 days.

(21) Appl. No.: 12/869,369

(22) Filed: Aug. 26, 2010

(65) Prior Publication Data

US 2011/0048214 A1 Mar. 3, 2011

(30) Foreign Application Priority Data

Aug. 26, 2009 (JP) ..... 2009-195758

(51) Int. Cl.
*G10H 1/00* (2006.01)
*G10H 1/18* (2006.01)

(52) U.S. Cl. ..... 84/615; 84/612; 84/616; 84/652; 84/653; 84/654; 84/477 R

(58) Field of Classification Search ..... None
See application file for complete search history.

(56) References Cited

U.S. PATENT DOCUMENTS 7,019,205 B1 * 3/2006 Fujisawa et al. ..... 84/609
7,199,300 B2 * 4/2007 Kodama et al. ..... 84/601
7,528,313 B2 * 5/2009 Saijo ..... 84/609
7,667,122 B2 * 2/2010 Saijo ..... 84/611
7,705,230 B2 * 4/2010 Bowen ..... 84/612
2008/0078282 A1 * 4/2008 Saijo ..... 84/611
2010/0186578 A1 * 7/2010 Bowen ..... 84/612
2011/0048214 A1 * 3/2011 Asami ..... 84/615
2011/0179943 A1 * 7/2011 Bowen ..... 84/612
2011/0207513 A1 * 8/2011 Cross et al. ..... 463/7

FOREIGN PATENT DOCUMENTS

JP 3579042 B1 10/2004

OTHER PUBLICATIONS

"Guitar Hero", 2005—From Wikipedia, the free encyclopedia.*

* cited by examiner

*Primary Examiner* — Marlo Fletcher
(74) *Attorney, Agent, or Firm* — Howard & Howard Attorneys PLLC

(57) ABSTRACT

A music information memory unit stores music information including identification information on each piece of music and pace information thereof. A process control unit selects out a predetermined number of pieces of music information each of whose identification information is to be presented from the music information memory unit. A notification image generating unit generates a notification image in which an object is moved in a scrolling manner based on the pace information of each piece of the selected music information. An image display control unit synthesizes the identification information of each piece of the selected music information with each of the generated notification images, and displays the synthesized image.

9 Claims, 9 Drawing Sheets

SELECTING DEVICE, SELECTING METHOD, AND INFORMATION RECORDING MEDIUM

CROSS-REFERENCE TO RELATED APPLICATION

This application claims the benefit of Japanese Patent Application No. 2009-195758, filed on Aug. 26, 2009, the entire disclosure of which is incorporated by reference herein.

FIELD OF THE INVENTION

The present invention relates to a selecting device and a selecting method which facilitate selection of appropriate music among plural pieces of music, and an information recording medium.

BACKGROUND OF THE INVENTION

Various games (e.g., softwares and the like) executed in a commercial or a home-use game device have been developed. Among such games, games so-called a music game (including a dancing game and the like) are persistently popular and are favored by players of all ages.

In such music game, a player competes to gain a higher score, performing an operation corresponding to a pace, a scale or the like of played music at a right timing.

An explanation will be given of an example in detail. Plural moving lanes are provided in a game screen. Task objects are displayed so as to move on the respective moving lanes in accordance with played (reproduced) music. More specifically, for each moving lane, a different task object appears, and moves on a moving lane from a starting point to an end point in accordance with a music tone. These task objects are associated with buttons on a controller (including a gaming mat or the like) manipulated by a player. These task objects instruct the player to press a corresponding button. Moreover, a determination area is provided so as to traverse each moving lane, and is represented as straight line or object.

At a timing when a task object moving on a moving lane reaches the determination area, as the player presses a button corresponding to that task object, a score can be acquired.

That is, it is requisite for the player to press a corresponding button at a right timing. The player follows the task object moving in accordance with music with his/her eyes and presses the button.

As an example of such music game, Japanese Patent No. 3579042 (see, pages 7 to 15, and FIG. 4) discloses a technology of a game device which can change the level of difficulty in accordance with the game status or the like of a player.

SUMMARY

In such music game, a music selecting screen is displayed before a player starts a game. The player can freely select music that the player wants to play. In the music selecting screen, for example, the speed of music, i.e., a pace (BPM: Beats Per Minute) is displayed by a numerical value. The player can select music by referring to the pace of the music.

Although a pace of music is displayed by a numerical value, however, it is often difficult for a player to intuitively figure out the speed of the music from that numerical value. In particular, a child player, a beginner player or the like often cannot understand what a numerical value indicates, or misses the display of the numerical value.

An intermediate player or an expert player can figure out the speed of music to some extent from a displayed numerical value for the pace of music. However, it is still difficult for the player to further figure out a specific level of difficulty unless playing a music game with that music in practice.

Accordingly, there is a demand for the development of a music game which allows a player to figure out a more specific speed and level of difficulty when music is selected and to select appropriate music.

The present invention has been made in view of foregoing circumstances, and it is an object of the present invention to provide a selecting device and a selecting method which facilitate selection of appropriate music among plural pieces of music, and an information recording medium.

A selecting device according to a first aspect of the present invention enables selection of any piece of music among plural pieces of music, and comprises an extracting unit, an acquiring unit, and a presenting unit.

First, the extracting unit extracts music whose identification information is to be presented. The acquiring unit acquires identification information (e.g., a name of music) and pace information on the extracted music. The presenting unit changes a display appearance of an image including contents of the acquired identification information based on the acquired pace information, thereby to present a speed of music. For example, the presenting unit moves a predetermined indicator (e.g., a task object in a game) in an image including the name of music at a speed proportional to a pace of the music, thereby to notify a speed of the music.

Accordingly, a player can more specifically figure out the pace of the music from the change in a display appearance such that the indicator moves in the image. Consequently, it becomes possible for the player to select music suitable for his/her ability or the way he/she plays a game.

As a result, appropriate music can be easily selected among plural pieces of music.

A selecting device according to a second aspect of the present invention presents identification information on each piece of music to allow a player to select music to be played among plural pieces of music, and comprises a music information memory unit, a selecting-out unit, a notification image generating unit, and an image display control unit.

The music information memory unit stores music information including identification information (e.g., a name of music) and pace information on each piece of music. The selecting-out unit selects out a predetermined number of pieces of music information each of whose identification information is to be presented from the music information memory unit. The notification image generating unit generates a notification image which comprises a plurality of motion images corresponding to each piece of the selected music information and which is for moving and displaying a predetermined indicator therein based on the pace information. For example, the notification image generating unit moves an indicator (e.g., a task object in a game) in a scrolling manner in a notification image at a speed proportional to a pace of music, thereby to present a speed of the music. The image display control unit synthesizes each image including contents of the identification information on each piece of the selected music information with each generated notification image of each piece of the selected music information and displays the synthesized image.

Accordingly, a player can more specifically figure out a pace of each piece of music from a speed of an indicator moving in each notification image or the like. Consequently, it becomes possible for the player to select music suitable for his/her ability or the way he/she plays a game.

As a result, appropriate music can be easily selected among plural pieces of music.

Plural kinds of indicators are provided as the indicator, and a different area in a notification image may be allocated to the indicator according to the kinds of the indicator, and the notification image generating unit may move and display various kinds of indicators at a speed proportional to a pace settled by the pace information in respective areas in the notification image.

In this case, various kinds of the indicators move in the respective areas in the notification image at a speed in accordance with the pace, thereby allowing the player to more specifically figure out the pace of the music.

The music information memory unit may store music information which further includes task information on each piece of music in a game. The notification image generating unit may cause an indicator to appear based on the task information on music, and may move and display the indicator at a speed in proportion to a pace settled by the pace information on the music in a notification image.

In this case, the indicator more specifically presents at which timing and how frequently a task is given when the player plays the game with that music, so that the player can also figure out the level of difficulty of the game and the like.

The above-explained selecting devices may further comprise a selecting unit which selects any piece of the displayed identification information based on a position of a cursor, and the image display control unit may flash and display the cursor at a frequency in proportion to a pace settled by the pace information of the identification information currently selected by the selecting unit.

In this case, a pace of currently-selected music is also notified by flashing of the cursor, so that the player can more specifically figure out the pace of the music.

A selecting method according to a third aspect of the present invention is executed by a selecting device which enables selection of any piece of music among plural pieces of music, and comprises an extracting step, an acquiring step, and a presenting step.

Note that the selecting device comprises a selecting-out unit, an acquiring unit, and a presenting unit.

First, in the extracting step, music whose identification information is to be presented is extracted.

In the acquiring step, identification information and pace information on the extracted music are acquired.

In the presenting step, as a display appearance of an image including contents of the acquired identification information is changed based on the acquired pace information, and thus a speed of music is presented.

Accordingly, a player can more specifically figure out a pace of each piece of music.

A selecting method according to a fourth aspect of the present invention is executed by a selecting device which presents identification information on each piece of music to allow a player to select music to be played among plural pieces of music, and comprises a selecting-out step, a notification image generating step, and an image display control step.

Note that the selecting device comprises a music information memory unit, a selecting-out unit, a notification image generating unit, and an image display control unit, and the music information memory unit stores music information including identification information and pace information on each piece of music.

First, in the selecting-out step, a predetermined number of pieces of music information each of whose identification information is to be presented are selected out from the music information memory unit. In the notification image generating step, a notification image which comprises a plurality of motion images corresponding to each piece of the selected music information and which is for moving and displaying a predetermined indicator therein based on the pace information is generated. For example, in the notification image generating step, as an indicator (e.g., a task object in a game) is moved in a scrolling manner in a notification image at a speed proportional to a pace of music, a speed of the music is presented. In the image display control step, each image including contents of the identification information of each piece of the selected music information is synthesized with each generated notification image of each piece of the selected music information and the synthesized image is displayed.

Accordingly, a player can more specifically figure out a pace of each piece of music from a speed of an indicator moving in each notification image or the like, and can select music suitable for his/her ability or the way he/she plays a game.

As a result, appropriate music can be easily selected among plural pieces of music.

An information recording medium according to a fifth aspect of the present invention records a program which allows a computer that enables selection of any piece of music among plural pieces of music to function as an extracting unit, an acquiring unit, and a presenting unit.

The extracting unit extracts music whose identification information is to be presented.

The acquiring unit acquires identification information and pace information on the extracted music.

The presenting unit changes a display appearance of an image including contents of the acquired identification information based on the acquired pace information, thereby to present a speed of music.

According to the present invention, a computer (including an electronic device) which enables selection of any piece of music among plural pieces of music can function as the above-explained selecting devices.

An information recording medium according to a sixth aspect of the present invention records a program which allows a computer that presents identification information on each piece of music to allow a player to select music to be played among plural pieces of music to function as a music information memory unit, a selecting-out unit, a notification image generating unit, and an image display control unit.

The music information memory unit stores music information including identification information and pace information on each piece of music.

The selecting-out unit selects out a predetermined number of pieces of music information each of whose identification information is to be presented from the music information memory unit.

The notification image generating unit generates a notification image which comprises a plurality of motion images corresponding to each piece of the selected music information and which is for moving and displaying a predetermined indicator therein based on the pace information.

The image display control unit synthesizes each image including contents of the identification information on each piece of the selected music information with each generated notification image of each piece of the selected music information and displays the synthesized image.

According to the present invention, a computer (including an electronic device) which presents identification information on each piece of music to allow a player to select music to be played among plural pieces of music can function as the above-explained selecting device.

The information recording medium may be a computer-readable information recording medium, such as a compact disk, a flexible disk, a hard disk, a magneto-optical disk, a digital video disk, a magnetic tape, or a semiconductor memory.

The program recorded in the information recording medium can be distributed and sold over a computer communication network independently from a computer which runs the program. Moreover, the information recording medium can be distributed and sold independently from that computer.

According to the present invention, it is possible to provide the selecting device and the selecting method which facilitate selection of appropriate music among plural pieces of music, and the information recording medium.

BRIEF DESCRIPTION OF THE DRAWINGS

A more complete understanding of this application can be obtained when the following detailed description is considered in conjunction with the following drawings, in which.

DETAILED DESCRIPTION

An explanation will be given of an embodiment of the present invention. In order to facilitate understanding, the explanation below will be given of the embodiment in which the present invention is applied to a game device, but the present invention can be applied to various information processing devices, such as computers, PDAs, and cellular phones in the same manner as the embodiment. That is, the embodiment to be explained below is merely for explanation, and is not to limit the scope of the present invention. Consequently, those skilled in the art can adopt embodiments in which some of or all of the structural elements are replaced with respective equivalents, and it should be understood that such embodiments are included within the scope of the present invention.

<First Embodiment>

Figure 1:
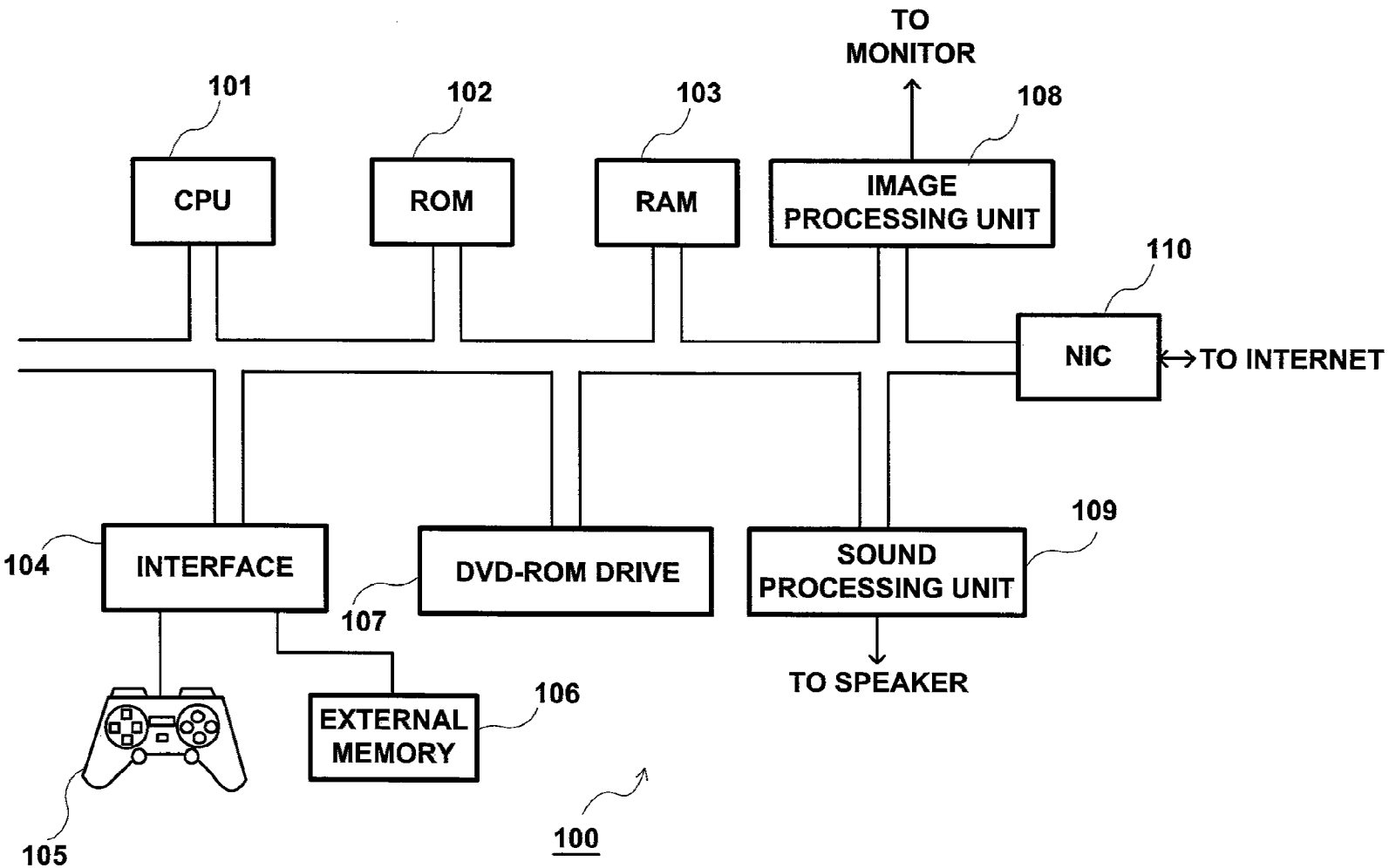
FIG. 1 is a block diagram showing a general configuration of a typical game device which realizes a selecting device according to an embodiment.

FIG. 1 is a block diagram showing a general configuration of a typical game device which realizes a selecting device according to an embodiment of the present invention. An explanation will be given with reference to this diagram.

A game device 100 comprises a CPU (Central Processing Unit) 101, a ROM (Read Only Memory) 102, a RAM (Random Access Memory) 103, an interface 104, a controller 105, an external memory 106, a DVD (Digital Versatile Disc)-ROM drive 107, an image processing unit 108, a sound processing unit 109, and an NIC (Network Interface Card) 110.

First, a player loads a DVD-ROM which stores a program and data for games in the DVD-ROM drive 107. Next, the player powers on the game device 100. This allows the program to be run and the selecting device of the embodiment is realized.

The CPU 101 controls the overall operation of the game device 100, and is connected to each structural element to exchange control signals and data.

The ROM 102 records an IPL (Initial Program Loader) to be executed immediately after the game device 100 is powered on. As the IPL is executed, the program recorded in the DVD-ROM is read out in the RAM 103. Thereafter, the CPU 101 runs the program. Moreover, the ROM 102 records an operating system program and various data necessary for controlling the overall operation of the game device 100.

The RAM 103 temporarily stores data and programs. The RAM 103 retains the program and data which are read out from the DVD-ROM, and other data necessary for the progress of a game or for a chat communication.

The controller 105 is connected operably through the interface 104. The controller 105 receives an operation input performed when a user plays a game. For example, the controller 105 receives an input of letter strings (messages) or the like in accordance with an operation input.

The external memory 106 is connected detachably through the interface 104. The external memory 106 stores data indicating a progress status of the game, data of the log (a record) of a chat communication and the like. The external memory 106 is rewritable. The external memory 106 as needed by giving an instruction input through the controller 105.

The DVD-ROM loaded in the DVD-ROM drive 107 records programs for realizing the game, and image data and sound data accompanying the game. Under the control of the CPU 101, the DVD-ROM drive 107 performs a read-out process on the DVD-ROM loaded therein. The DVD-ROM drive 107 reads out necessary program and data. The read-out program and data are temporarily stored in the RAM 103 or the like.

The image processing unit 108 causes the CPU 101 or an image computation processor (not illustrated) possessed by the image processing unit 108 to process the data read out from the DVD-ROM. Thereafter, the image processing unit 108 records such processed data in a frame memory (not illustrated). Image information recorded in the frame memory is converted into a video signal (an image signal) at a predetermined synchronization timing, and is output to a monitor connected to the image processing unit 108. This enables various-image display.

Note that the image computation processor can perform overlay calculation of two-dimensional images, transparency calculation like cc blending, and various saturation calculations at a high speed.

A polygon is arranged in a virtual three-dimensional space. Various pieces of texture information are affixed to polygon information. A calculation of acquiring a rendered image can be performed at a high speed by rendering the polygon information through Z-buffering. Note that the rendered image is a image in which the polygon arranged in the virtual three-dimensional space and is panoramically viewed from a predetermined view position.

Moreover, the CPU 101 and the image computation processor can work together to depict letter strings. Font information defines the shape of a letter. Based on the font information, an image representing the letter strings is depicted as a two-dimensional image in the frame memory or on the surface of a polygon. The font information is recorded in the ROM 102. However, exclusive font information recorded in the DVD-ROM can be also used instead.

The sound processing unit 109 converts sound data which is read out from the DVD-ROM into an analog sound signal. The sound processing unit 109 supplies the analog sound signal to an external speaker and causes the speaker to output sound. For example, the sound processing unit 109 generates sound effects and music data to be output during the progress of the game under the control of the CPU 101. The sound processing unit 109 causes the speaker to output sound corresponding to the generated sound data.

The NIC 110 is used when the game device 100 is connected to a computer communication network (not illustrated) like the Internet. The NIC 110 is an interface which intermediates the Internet-connecting device (not illustrated) and the CPU 101. Such Internet-connecting device may be a 10BASE-T/100BASE-T compatible product which is used for establishing a LAN (Local Area Network), an analog modem, an ISDN (Integrated Services Digital Network) modem, and an ADSL (Asymmetric Digital Subscriber Line) modem which are for connecting to the Internet via a telephone line, or a cable modem for connecting to the Internet via a cable television line.

Moreover, the game device 100 may use a large-capacity external memory device like a hard disk drive, and may configure it to have the same function as the ROM 102, the RAM 103, the external memory 106, the DVD-ROM loaded in the DVD-ROM drive 107 and the like.

Furthermore, a configuration in which a keyboard and a mouse are connected may be employed. The keyboard receives an editing input of letter strings from a player. The mouse receives inputs of specifying and selecting various positions.

Moreover, instead of the game device 100 of the embodiment, a general computer (e.g., a general-purpose personal computer) can be used as the selecting device. For example, a general computer comprises, like the game device 100, a CPU, a RAM, a ROM, a DVD-ROM drive, and an NIC. The general computer further comprises an image processing unit which has a simpler function than that of the game device 100, and has a hard disk drive as an external storage unit. In the general computer, a flexible disk, a magneto-optical disk, a magnetic tape and the like can be used. Furthermore, a keyboard and a mouse are used as input devices instead of a controller. As a game program is installed therein and is run, the general computer functions as the selecting device.

<General Configuration of Selecting Device>

Figure 2A:
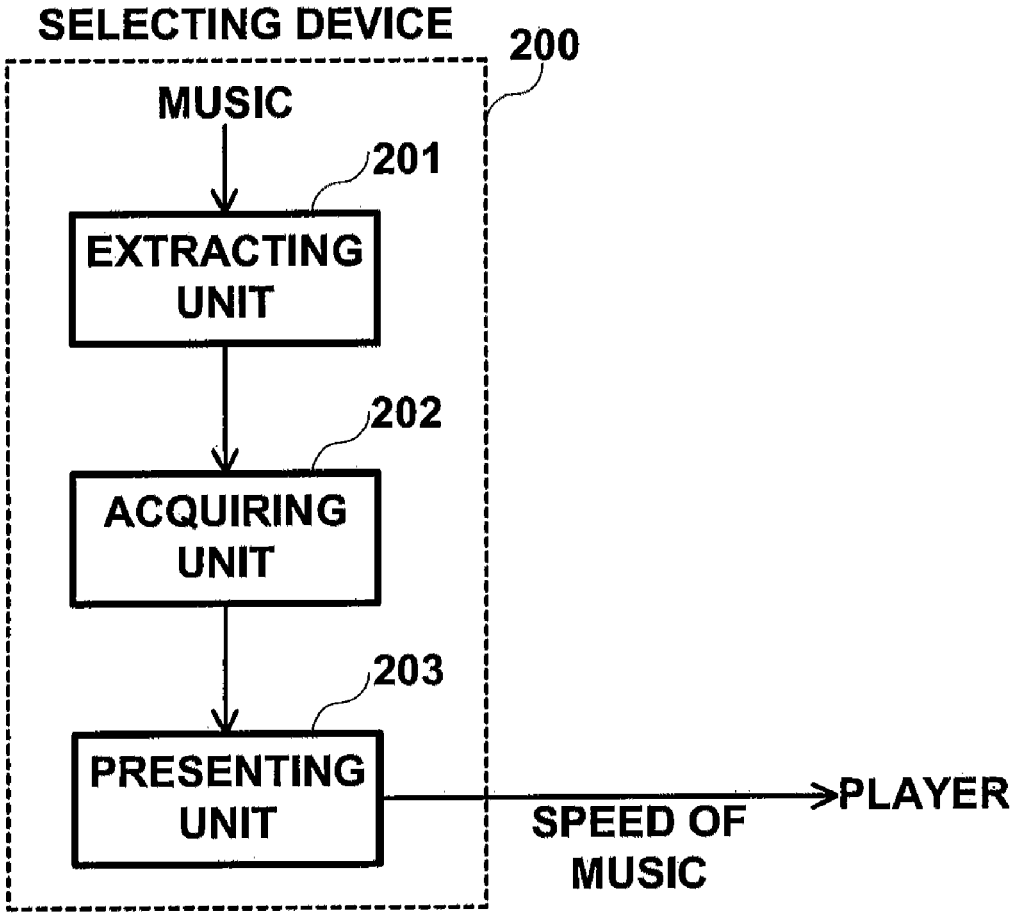
FIG. 2A is a block diagram for explaining a general configuration of the selecting device according to the embodiment.

FIG. 2A is a block diagram showing a general configuration of a selecting device 200.

The selecting device 200 comprises an extracting unit 201, an acquiring unit 202, and a presenting unit 203.

The extracting unit 201 extracts music whose identification information is to be presented. The acquiring unit 202 acquires identification information and pace information on the extracted music. The presenting unit 203 changes a display appearance of an image including contents of the acquired identification information based on the acquired pace information, thereby presenting a speed of the music.

For example, the presenting unit 203 moves a predetermined indicator (e.g., a task object in a game) in an image including the name of music at a speed proportional to a pace of the music, thereby notifying a speed of the music.

An example of the selecting device 200 will be explained in more detail.

Figure 2B:
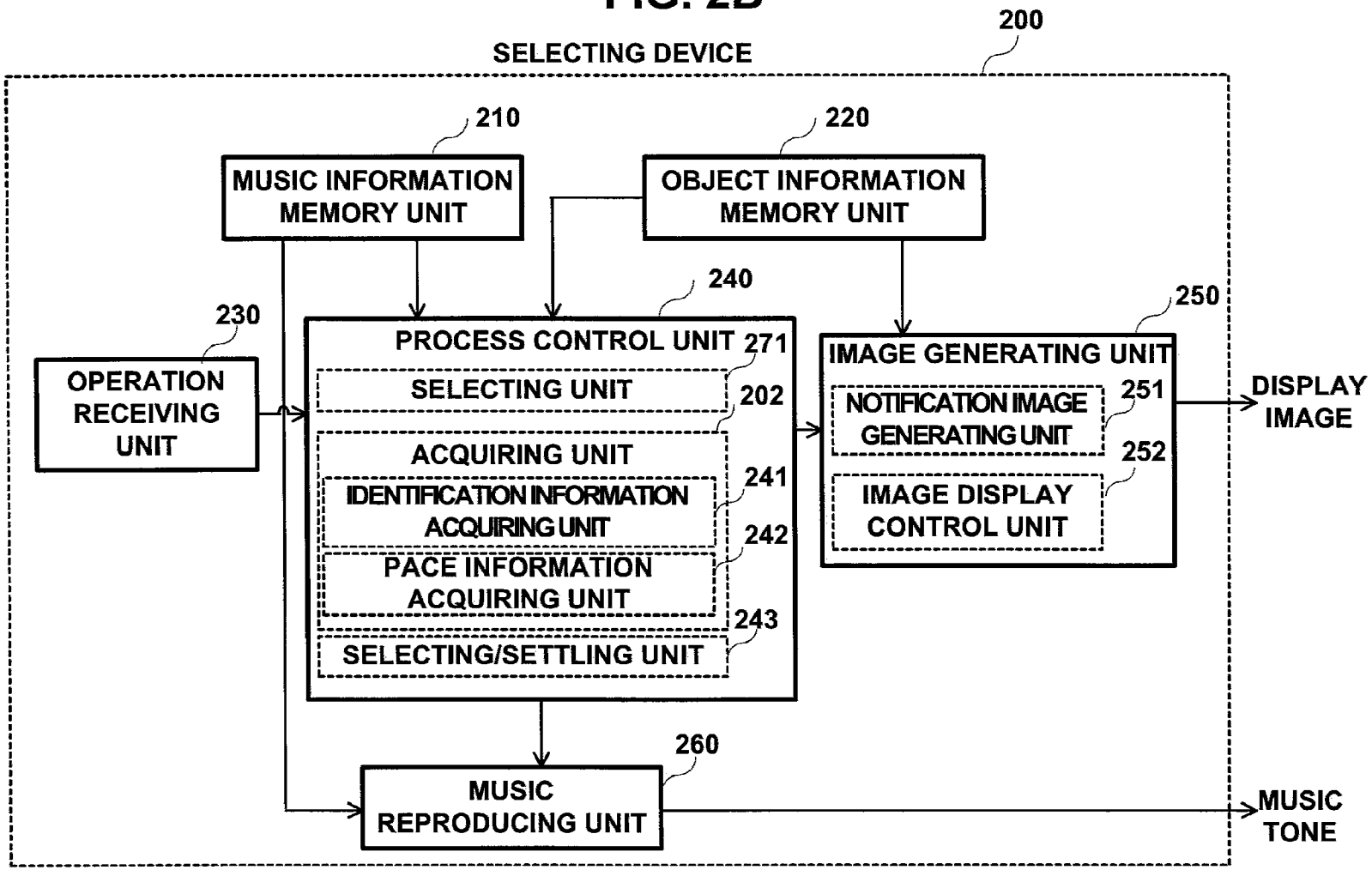
FIG. 2B is an exemplary diagram of FIG. 2A showing the configuration of the selecting device in more detail.

FIG. 2B is a block diagram showing a general configuration of the selecting device 200. Note that when music is selected, the selecting device 200 more specifically presents a pace of each piece of music and the like to facilitate selection of music. Let us suppose that the selecting device 200 executes a music game with music selected by a player. An explanation will be given with reference to this diagram.

The selecting device 200 comprises a music information memory unit 210, an object information memory unit 220, an operation receiving unit 230, a process control unit 240, an image generating unit 250, and a music reproducing unit 260.

First, the music information memory unit 210 stores information of plural pieces of music information to be played (reproduced) as task music of the music game. The music information memory unit 210 stores music information in a predetermined format like an MIDI (Musical Instrument Digital Interface) data. The player can select favorite music, and can play the music game with a reproduced tone (a music tone) of the selected music.

Moreover, the music information memory unit 210 further stores, for each piece of music, identification information, such as a name of music and that of a singer, and pace information indicating a pace (a rhythm) of music. The pace information can be, for example, a value of a BPM (Beats Per Minute).

Note that the DVD-ROM loaded in the DVD-ROM drive 107, the RAM 103 and the like can function as the music information memory unit 210.

The object information memory unit 220 stores various information on various kinds of objects (e.g., image information, positional information) each configuring a display image of the music game.

For example, the object information memory unit 220 stores information on various kinds of objects each configuring a game screen while the player is playing the game. Note that the object may be a task object, a moving lane, a determination area or the like. The task object is for specifying an operation to be made by the player (e.g., a button operation). The task object is displayed while moving in synchronization with a music tone (a pace). Moreover, the moving lane is a route of the movement of the task object. The determination area is a rough indication for an operation timing by the player.

Moreover, the object information memory unit 220 stores information on an object configuring a music selecting screen displayed before the game starts. The music selecting screen is for allowing the player to select music to be played. The music selecting screen displays a name of music and the like. A specific music selecting screen will be discussed later in more detail.

Note that the DVD-ROM loaded in the DVD-ROM drive 107, the RAM 103 and the like can function as the object information memory unit 220.

The object information memory unit 220 can be omitted accordingly.

The operation receiving unit 230 receives various operations given by the player in the music game.

For example, the operation receiving unit 230 sequentially receives various operations which are input by the player in accordance with a game screen while the player is playing the game. Such operation may be, for example, a button operation corresponding to a task object which has reached the determination area.

Moreover, prior to this operation, the operation receiving unit 230 receives various operations which are input by the player through the music selecting screen before the game starts. Such operations may be, for example, button operations for changing music, and for setting music to be selected.

When receiving such operations, the operation receiving unit 230 supplies operation information indicating contents of such operations (e.g., which button is pressed) to the process control unit 240.

Note that the controller 105 can function as the operation receiving unit 230.

The operation receiving unit 230 can be omitted accordingly.

The process control unit 240 controls the whole selecting device 200.

For example, the process control unit 240 controls the image generating unit 250 to generate a game screen while the player is playing the music game. Moreover, the process control unit 240 controls the music reproducing unit 260 to reproduce a music tone. The process control unit 240 determines whether or not an operation by the player acquired from the operation receiving unit 230 succeeds based on information to be a criterion while the player is playing the music game. The criterion information may be, for example, determination criterion information corresponding to a task.

Moreover, the process control unit 240 controls the image generating unit 250 to generate a music selecting screen before the player plays the music game, and allows the player to freely select music that the player wants to play. At this time, as will be discussed later, the process control unit 240 presents a speed of music (a pace) more specifically so that the player can easily select music suitable for himself/herself. Accordingly, the process control unit 240 is configured to include a selecting-out unit 271, the acquiring unit 202, and a selecting/settling unit 243. Note that the acquiring unit 202 is configured to include an identification information acquiring unit 241 and a pace information acquiring unit 242.

The selecting-out unit 271 selects out a predetermined number of pieces of music to be presented in the music selecting screen. That is, the predetermined number of pieces of music to be presented are selected out from the music information memory unit 210. Note that when music is selected out, the selecting-out unit 271 selects out the predetermined number of pieces of music in the alphabetical order of the name of music or a code order from the first, or in descending order of play frequency. How to select out music is arbitrary, and other selecting-out techniques may be also adopted. Moreover, the selecting-out unit 271 may select out music at random.

The identification information acquiring unit 241 acquires identification information on each piece of music selected out by the selecting-out unit 271. That is, the identification information acquiring unit 241 reads out identification information (e.g., a name of music and that of a singer) on each piece of selected music.

The pace information acquiring unit 242 acquires pace information of the music acquired by the identification information acquiring unit 241. That is, the pace information acquiring unit 242 reads out pace information (e.g., the BPM) of target music from the music information memory unit 210. Note that the pace information acquiring unit 242 may analyze the music (the music information) through a predetermined technique to acquire the pace information like the BPM.

In the music selecting screen, the selecting/settling unit 243 allows the player to select (choose) arbitrary music in accordance with an operation given by the player among the pieces of music selected by the identification information acquiring unit 241, and sets (settles) selection of desired music. Note that regarding selection/setting of music, an explanation will be given again together with the explanation for the image generating unit 250 to be discussed later.

The CPU 101 can function as the process control unit 240.

The image generating unit 250 is controlled by the process control unit 240, and generates a display image of the music game.

For example, after the music game starts, the image generating unit 250 generates a game image in which a task object is displayed while moving in synchronization with a music tone.

Moreover, prior to this operation, the image generating unit 250 generates a music selecting screen for allowing the player to select music to be played.

Figure 3:
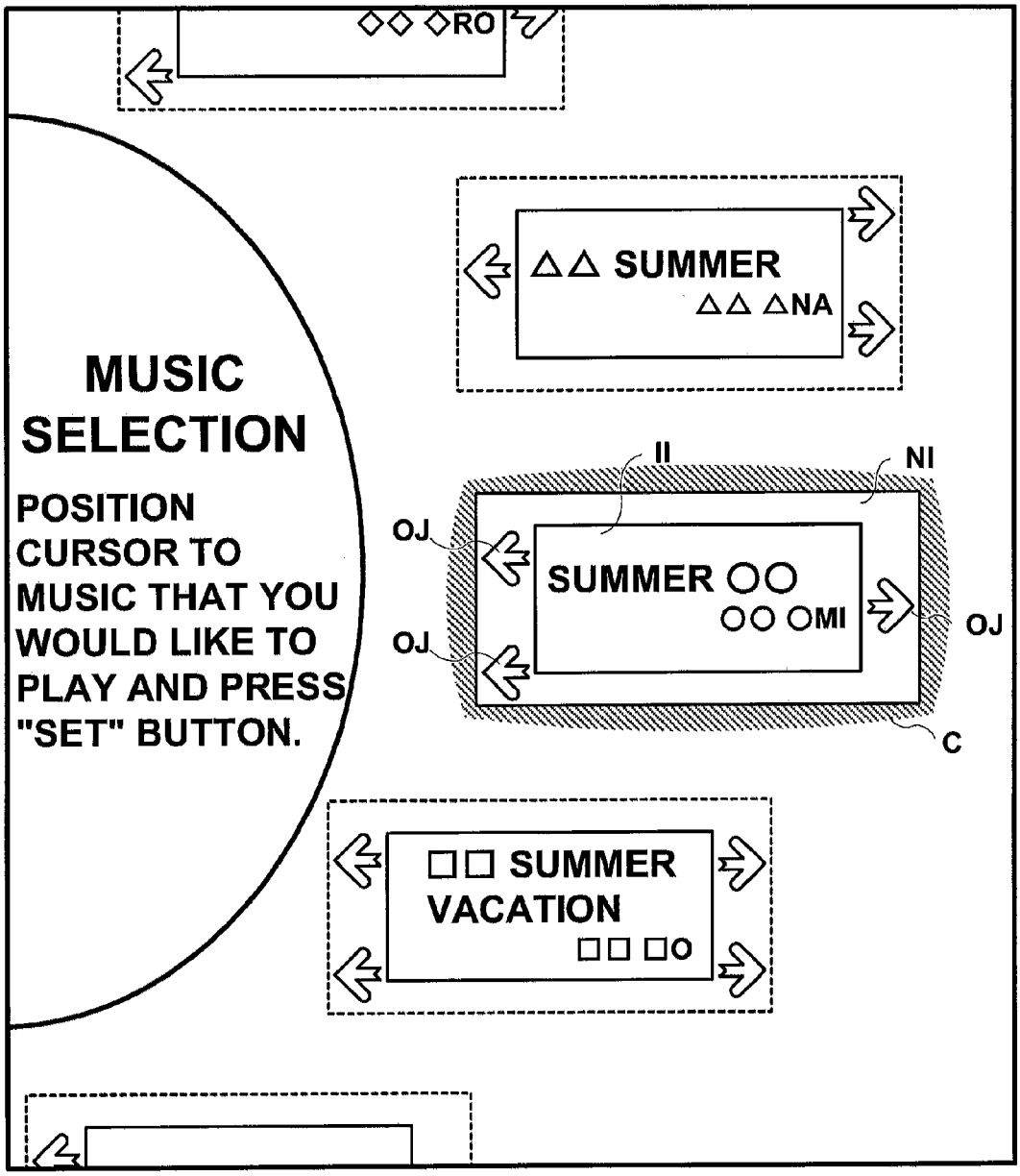
FIG. 3 is an exemplary diagram showing an example of a music selecting screen generated by an image generating unit.

More specifically, the image generating unit 250 generates a music selecting screen as shown in FIG. 3. In FIG. 3, as an example, in the music selecting screen, the player positions a cursor C to music (identification information II and notification image NI thereof) that the player wants to play, thereby selecting (specifying) the music. Next, the player gives a predetermined setting instruction (e.g., pressing of a set button) to set (settle) that music.

The image generating unit 250 which generates such music selecting screen is configured to include a notification image generating unit 251, and an image display control unit 252.

The notification image generating unit 251 generates a notification image for each piece of music in the music selecting screen so as to facilitate notification of a speed of each piece of music. That is, the notification image generating unit 251 generates the notification images NI in the music selecting screen shown in FIG. 3 for the respective pieces of music. The notification image NI is, for example, synthesized at an external edge part of the identification information II on a name of music and the like. In the notification image NI to be generated, an object OJ moves in a scrolling manner in the image at a speed based on a pace of music.

Figure 4A:
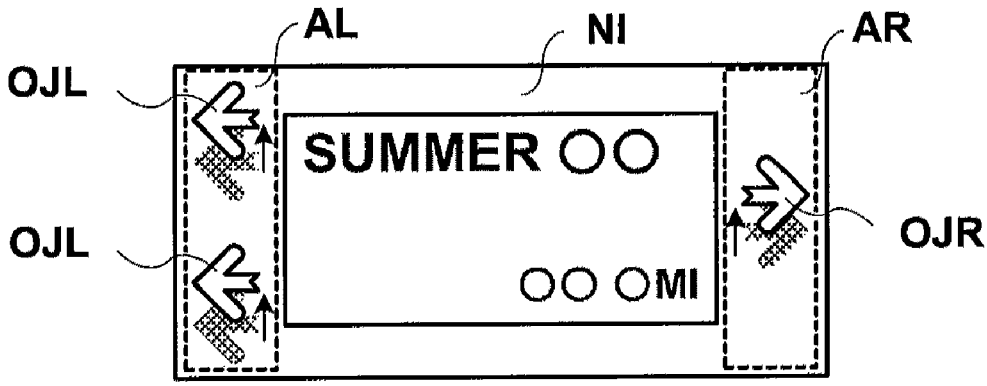
FIG. 4A is an exemplary diagram for explaining a notification image in detail.

More specifically, the object OJ is an indicator for notifying a pace of music. The object OJ corresponds to, for example, a task object in the game. The notification image generating unit 251 generates, for example, the notification image NI as shown in FIG. 4A. In the notification image NI in FIG. 4A, in areas at right and left sides (areas AL, AR), two kinds of objects (objects OJL, OJR) move in a scrolling manner in a fixed direction (e.g., from bottom to top) at a speed in proportion to a pace of music. That is, respective different areas in the notification image are allocated to various kinds of the objects OJ in accordance with the kinds of the object. Various kinds of the objects OJ move in a scrolling manner in the respective areas in the notification image at a speed proportional to the pace of the music.

Note that a pace of each piece of music can be acquired from the pace information that the pace information acquiring unit 242 has read out from the music information memory unit 210. Moreover, the objects OJL and OJR in FIG. 4A correspond to any one kind (some kinds) of task objects in a game screen displayed while the player is playing the music game. Furthermore, the object moved by the notification image generating unit 251 is not limited to these two kinds, but is optional. Moreover, the direction in which the object is moved in a scrolling manner is also optional.

Figure 4B:
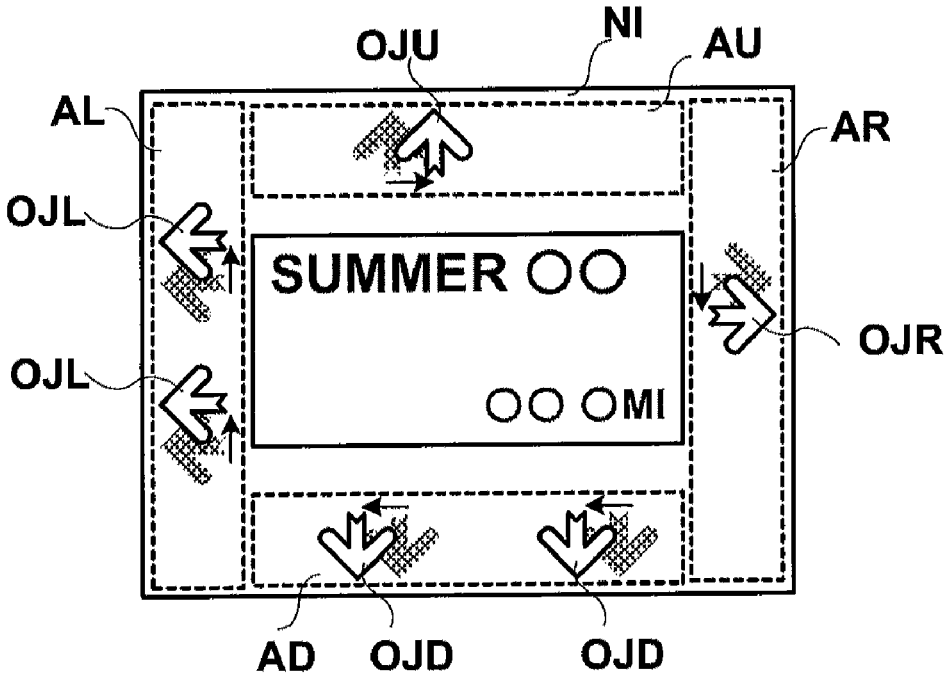
FIG. 4B is an exemplary diagram for explaining the notification image in detail.

For example, four kinds of objects as shown in FIG. 4B may be moved, respectively, in accordance with respective task objects in the game. The four kinds of objects are objects OJU, OJD, OJL, and OJR. In this case, the notification image generating unit 251 generates an image in which the objects (the objects OJU, OJD, OJL, and OJR) move in respective areas at the top, bottom, left and right sides (areas AU, AD, AL, and AR) at a speed in proportion to a pace of music in a fixed rotation direction (e.g., clockwise direction) in a scrolling manner.

As each object moves in a scrolling manner in such notification image, the player can easily figure out a pace of the music.

Returning now to FIG. 2, the image display control unit 252 synthesizes identification information on each piece of music and a notification image thereof together, and displays such synthesized identification information in the music selecting screen. That is, as shown in FIG. 3, the notification image NI is displayed as synthesized at the external edge part of the identification information II.

Figure 5A:
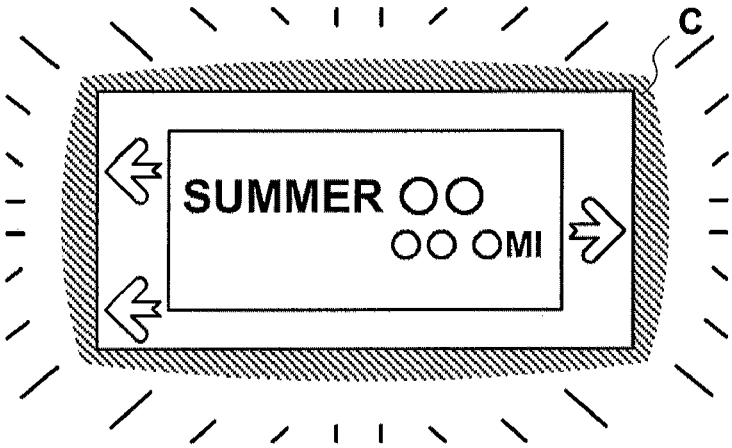
FIG. 5A is an exemplary diagram showing how a cursor is flashed.

Moreover, the image display control unit 252 flashes the cursor C shown in FIG. 3 based on pace information on music. For example, as shown in FIG. 5A, the image display control unit 252 flashes the cursor C at a speed in proportion to a pace of selected music. That is, the image display control unit 252 first acquires pace information on music on which the cursor C is currently positioned from the pace information acquiring unit 242. Next, the image display control unit 252 flashes the cursor C at a speed in proportion to a pace settled by the pace information.

Note that when the cursor C is moved by the player and music to be selected is changed by the selecting/settling unit 243, the image display control unit 252 flashes the cursor C at a speed in proportion to a pace of music to be selected after the change.

Figure 5B:
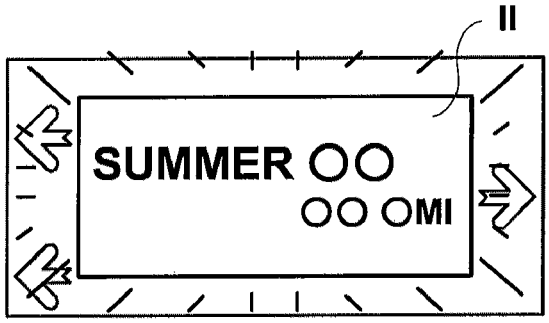
FIG. 5B is an exemplary diagram showing how identification information is flashed.
Figure 5C:
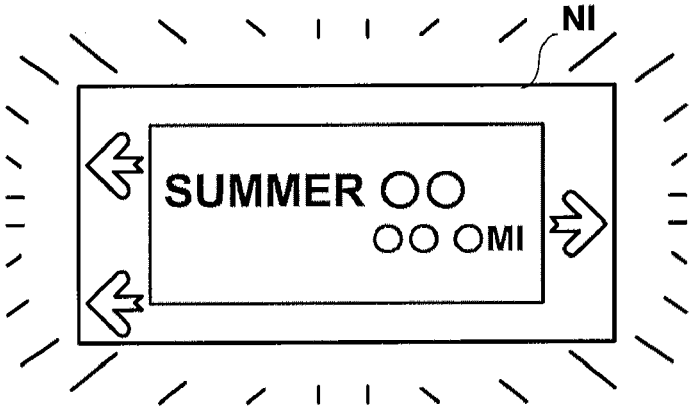
FIG. 5C is an exemplary diagram showing how the notification image is flashed.

Moreover, the image display control unit 252 may change the color, the brightness, or the shape of the cursor C with a pace of music other than flashing the cursor C in the foregoing manner. Furthermore, the image display control unit 252 may, for example, flash the identification information II and the notification image NI other than the cursor C. For example, as shown in FIG. 5B, the image display control unit 252 may flash the identification information II. Moreover, as shown in FIG. 5C, the image display control unit 252 may flash the notification image NI.

The image processing unit 108 as explained above can function as the image generating unit 250.

Returning now to FIG. 2, the music reproducing unit 260 is controlled by the process control unit 240, and reproduces a music tone of the music game. That is, the music reproducing unit 260 reproduces music selected (set) by the player in synchronization with the game. The reproduced music tone is output from a predetermined speaker or the like.

Note that the sound processing unit 109 as explained above can function as the music reproducing unit 260.

In the present embodiment, the extracting unit 201 is realized by the selecting-out unit 271, the acquiring unit 202 is realized by the identification information acquiring unit 241 and the pace information acquiring unit 242, and the presenting unit 203 is realized by the image generating unit 250.

<General Operation of Selecting Device>

Figure 6:
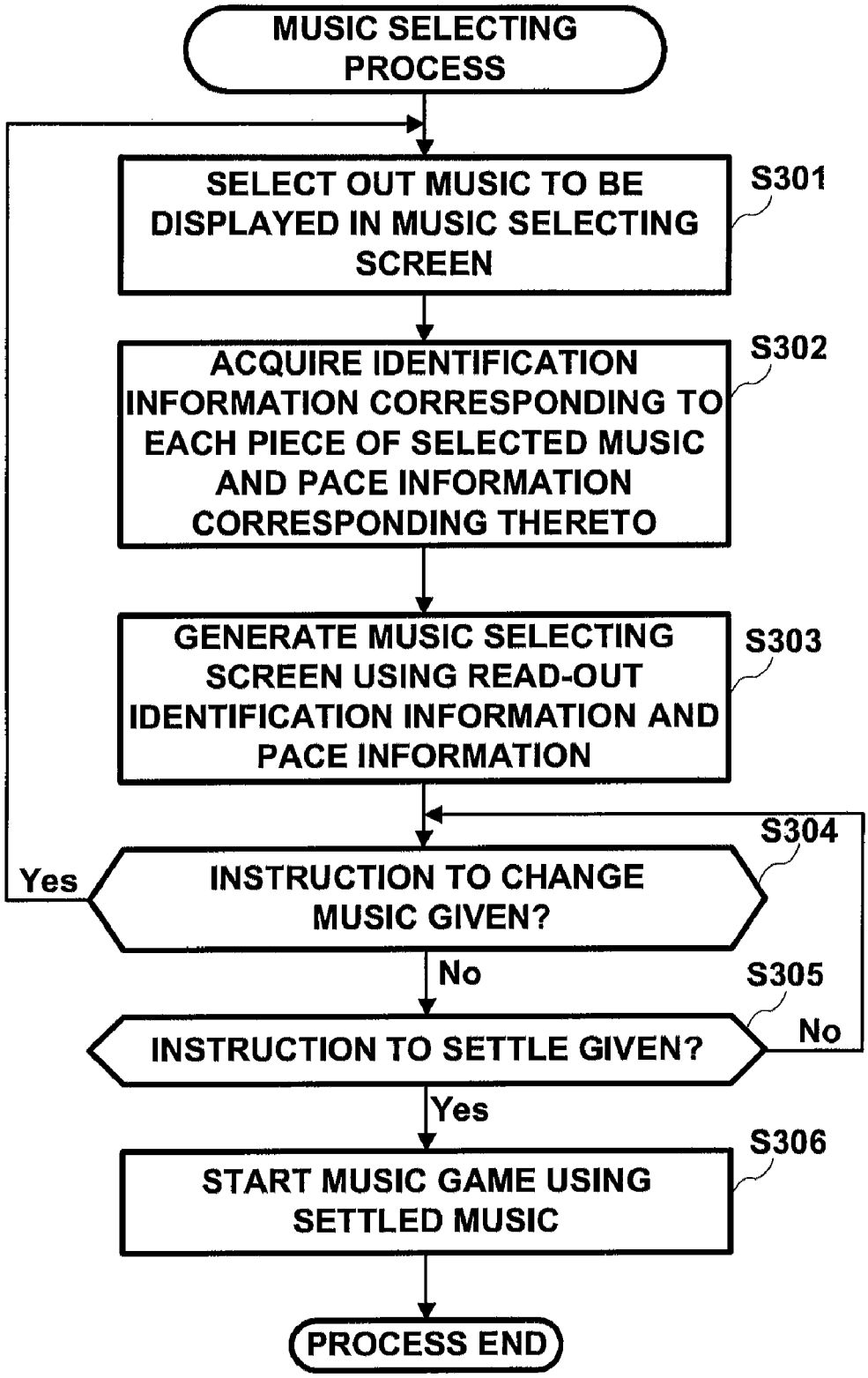
FIG. 6 is a flowchart for explaining a music selecting process according to the embodiment.

An explanation will be given of an operation of the selecting device 200 having the above-explained configuration with reference to accompanying drawings. As an example, the explanation will be given of an operation of the selecting device 200 when a player selects arbitrary music among plural pieces of music to play a music game. More specifically, the explanation will be given of an operation of the selecting device 200 performed before the music game is played with reference to FIG. 6. FIG. 6 is a flowchart showing a flow of a music selecting process executed by the selecting device 200.

First, the selecting device 200 selects out music to be displayed on a music selecting screen (step S301).

That is, the process control unit 240 selects out a predetermined number of pieces of music to be displayed in the music selecting screen from the music information memory unit 210. For example, the process control unit 240 selects out the predetermined number of pieces of music in the alphabetical order of the name of music or a code order from the first, or in descending order of play frequency.

Note that when the player gives an instruction of rearranging music or the like, the process control unit 240 starts over selection of target music in accordance with the instruction.

The selecting device 200 acquires identification information and pace information corresponding to each piece of selected music (step S302).

That is, the identification information acquiring unit 241 reads out the respective pieces of identification information II of the pieces of selected music from the music information memory unit 210. Moreover, the pace information acquiring unit 242 reads out the respective pieces of pace information on the pieces of selected music from the music information memory unit 210.

The selecting device 200 generates a music selecting screen using the read-out identification information II and pace information (step S303).

For example, the image generating unit 250 generates the music selecting screen as shown in FIG. 3. That is, the notification image generating unit 251 generates an image in which the objects (e.g., the objects OJL and OJR) as shown in FIG. 4A and the like are moved at a speed in proportion to a pace of music in a scrolling manner. As shown in FIG. 3, the image display control unit 252 synthesizes identification information II on music and notification image NI thereof together, and displays such synthesized image in the music selecting screen. Moreover, the image display control unit 252 flashes, for example, the cursor C shown in FIG. 3 at a speed in proportion to a pace of music on which the cursor C is positioned.

The selecting device 200 determines whether or not an instruction of changing music has been given (step S304).

That is, the selecting/settling unit 243 determines whether or not the operation receiving unit 230 has received an instruction of changing music in the music selecting screen. That is, the selecting/settling unit 243 determines whether or not an instruction of changing music to be selected by the movement of the cursor C, or an instruction of rearranging music or the like in the music selecting screen has been received through the music selecting screen in FIG. 3. When determining that the instruction of changing music has been received (step S304; Yes), the selecting device 200 returns the process to the step S301.

Conversely, when determining that no instruction of changing music has been received (step S304; No), the selecting device 200 determines whether or not setting (instruction of settlement) of selection has been performed (step S305).

That is, the selecting/settling unit 243 determines whether or not the operation receiving unit 230 has received a setting instruction. In other words, through the music selecting screen in FIG. 3, the selecting/settling unit 243 determines whether or not music selected by the cursor C has been settled through pressing of a set button or the like. When determining that no setting instruction has been received (step S305; No), the selecting device 200 returns the process to the step S304.

Conversely, when determining that the setting instruction has been received (step S305; Yes), the selecting device 200 starts the music game using the set (settled) music (step S306).

That is, the music reproducing unit 260 starts reproducing the set music. Moreover, the image generating unit 250 generates a game screen in synchronization with a music tone of the selected music.

In this manner, the player can easily figure out a pace of music through the music selecting screen displayed in the music selecting process. That is, an object in a notification image moves in a scrolling manner at a speed in accordance with a pace of music, thereby allowing the player to figure out a pace of each piece of music more specifically. In particular, with respect to music that the player attempts to select (a cursor is positioned), the cursor flashes at a speed in accordance with the pace of the music, thereby further facilitating the player to figure out the pace of the music together with the scrolling movement of the object.

Moreover, as a pace of each piece of music is notified through each notification image in the music selecting screen, it becomes also possible for the player to more specifically figure out a difference in pace of each music (how fast a speed of each piece of music is).

Accordingly, music appropriate for the player can be selected among plural pieces of music through such music selecting screen.

As a result, appropriate music can be easily selected among the plural pieces of music.

<Other Embodiments>

In the foregoing embodiment, the explanation has been given of a case in which an object is moved in a scrolling manner in a notification image so that a player can easily figure out a pace of music. However, the player may be allowed to figure out not only such pace of music, but also a specific level of difficulty and the like if the player plays a music game with that music.

Figure 7:
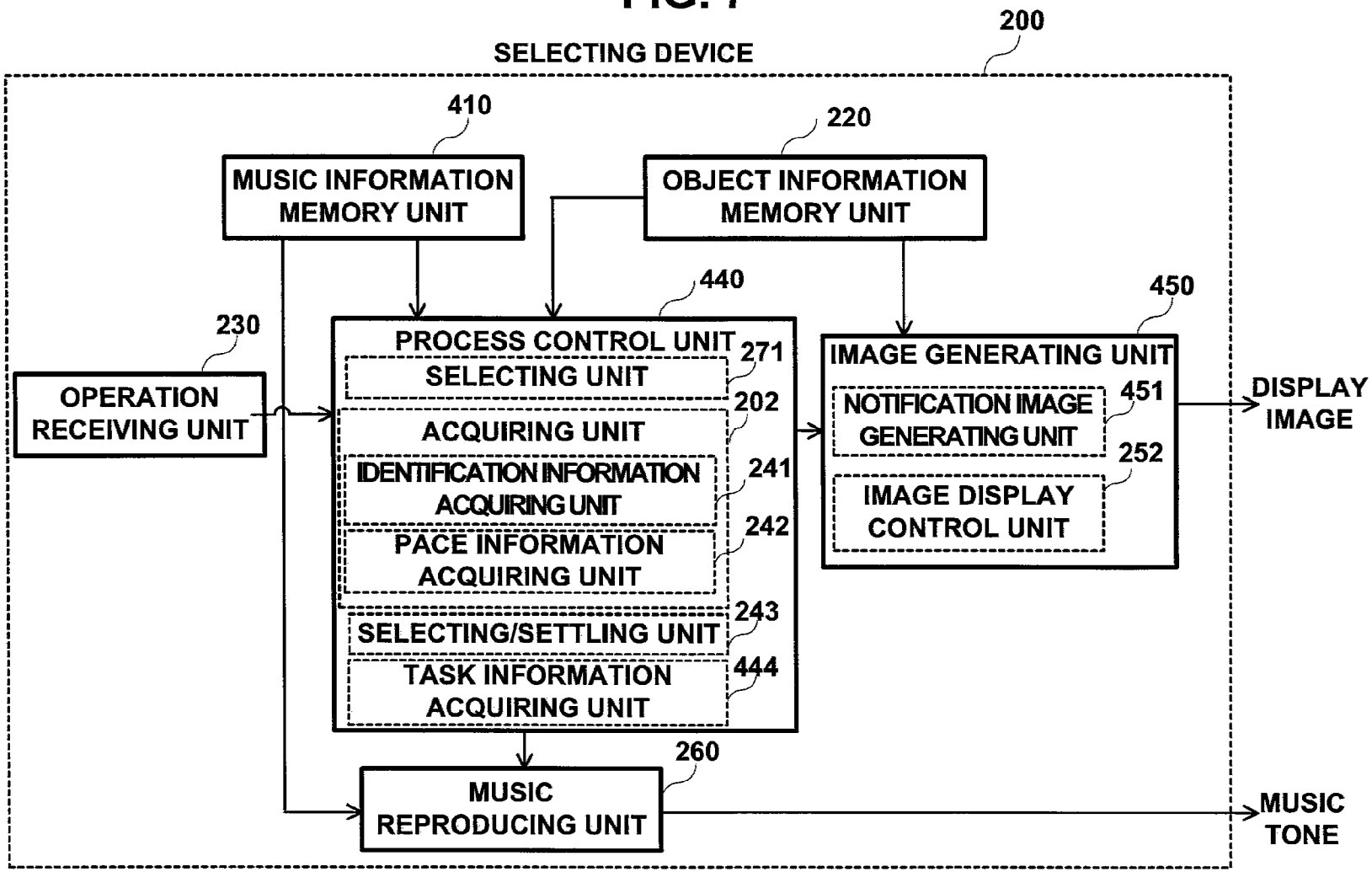
FIG. 7 is a block diagram for explaining a general configuration of a selecting device according to another embodiment.

An explanation will be given of a selecting device which further allows the player to figure out the level of difficulty and the like when the player plays a music game with music with reference to FIG. 7 and the like. FIG. 7 is a block diagram showing a general configuration of a selecting device 400 according to another embodiment of the present invention.

As shown in FIG. 7, the selecting device 400 comprises a music information memory unit 410, the object information memory unit 220, the operation receiving unit 230, a process control unit 440, an image generating unit 450, and the music reproducing unit 260.

Note that the object information memory unit 220, the operation receiving unit 230 and the music reproducing unit 260 have the same configurations as those of the above-explained selecting device 200 in FIG. 2, respectively.

The music information memory unit 410 stores music information, identification information, and pace information all stored in the music information memory unit 210 in the selecting device 200, and further stores task information. The task information is, for each piece of music, for defining a task to be given while the player is playing the music game. In the task information, for example, a timing when a task object appears while the player is playing the music game is defined.

The process control unit 440 is configured to further include a task information acquiring unit 444 in addition to the configuration of the process control unit 240 of the selecting device 200.

The task information acquiring unit 444 acquires task information on each piece of music to be presented in a music selecting screen. That is, the task information acquiring unit 444 reads out task information on target music from the music information memory unit 410.

In the image generating unit 450, the notification image generating unit 251 in the image generating unit 250 is replaced with a notification image generating unit 451. The notification image generating unit 451 generates a notification image slightly different from the notification image of the selecting device 200.

The notification image generating unit 451 generates a notification image for each piece of music in the music selecting screen so as to facilitate notification of the level of difficulty and the like when the player plays the music game as well as a speed of each piece of music.

Figure 8A:
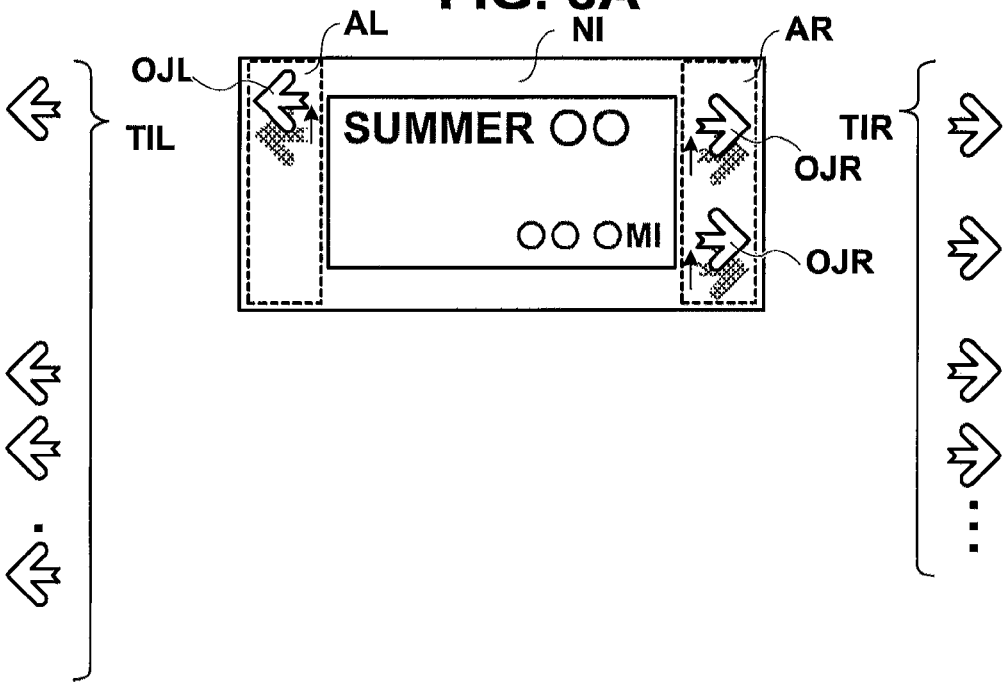
FIG. 8A is an exemplary diagram for explaining a notification image in detail according to another embodiment.

For example, as shown in FIG. 8A, the notification image generating unit 451 causes objects OJL and OJR to be moved in a scrolling manner in respective areas AL and AR in a notification image NI to sequentially appear based on task information TIL and TIR, and moves such objects in a scrolling manner at a speed in proportion to a pace in a fixed direction (e.g., from bottom to top).

Figure 8B:
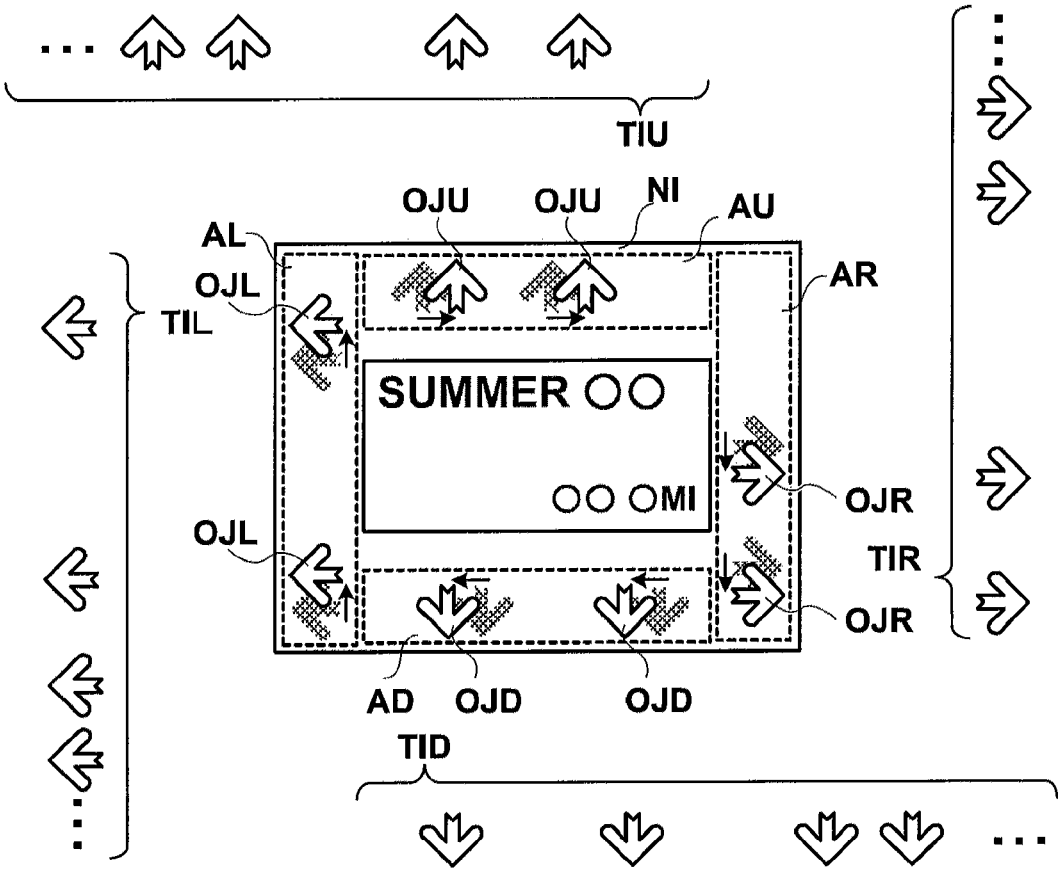
FIG. 8B is an exemplary diagram for explaining the notification image in detail according to another embodiment.

Moreover, as shown in FIG. 8B, the notification image generating unit 451 may cause objects OJU, OJD, OJL and OJR to be moved in a scrolling manner in respective areas AU, AD, AL and AR in the notification image NI to sequentially appear based on task information TIU, TID, TIL and TIR, and may move such objects in a scrolling manner at a speed in proportion to a pace in a fixed rotation direction (e.g., clockwise direction).

The selecting device 400 employing the above-explained configuration causes an object to appear at an appearance timing in accordance with a task of music. The selecting device 400 moves such object in a scrolling manner at a speed in accordance with a pace of the music.

Consequently, the player can more specifically figure out not only a speed of the music, but also the level of difficulty and the like when playing a music game. That is, the player can figure out, for example, at which timing a task object appears, how frequently the task object appears from a notification image.

As a result, the selecting device 400 of another embodiment can also allow the player to select music appropriate for the player among plural pieces of music.

In the foregoing embodiments, an object is caused to appear, and is moved at a speed in accordance with a pace of music. However, the selecting devices 200 and 400 may accordingly emphasize a moving object so as to further facilitate a player to figure out a pace of music.

For example, the image generating units 250 and 450 may display a residual image of an object to be moved in a scrolling manner. At this time, the image generating units 250 and 450 may change a length of the residual image in accordance with a pace of music.

In the foregoing embodiments, the explanations have been given of a case in which an object is moved in a scrolling manner in proportion to a pace of music in each notification image. However, the selecting devices 200 and 400 may emphasize a difference in pace of music presented in a music selecting screen and move the object in a scrolling manner.

For example, when five pieces of music are presented in a music selecting screen, the image generating units 250 and 450 compare respective paces of the five pieces of music one another, and specify a piece of music having a center value. Moreover, with respect to the other pieces of music, the image generating units 250 and 450 acquire a relative difference between the center value and a pace. With respect to the piece of music having the center value, the image generating units 250 and 450 move an object in a scrolling manner at a speed in proportion to a pace of that music. Conversely, with respect to the other pieces of music, the image generating units 250 and 450 move an object in a scrolling manner at a speed with a relative difference being emphasized. That is, with respect to a piece of music having a faster pace than the music having the center value, the image generating units 250 and 450 move an object faster (in an emphasized manner) in a scrolling manner. With respect to a piece of music having a slower pace than the music having the center value, the image generating units 250 and 450 move an object slower (in an emphasized manner) in a scrolling manner.

Note that when an instruction of changing music to be displayed is given by the selecting/settling unit 243, the image generating units 250 and 450 start over specification of a piece of music having a pace being a center value or the like with respect to new five pieces of music, and generates a notification image with a relative difference in pace being emphasized.

Moreover, instead of specifying a piece of music having a center value among respective paces of the five pieces of music, the image generating units 250 and 450 may acquire a relative difference in pace between a piece of music that a cursor is positioned and the other pieces of music. With respect to the piece of music that the cursor is positioned, the image generating units 250 and 450 may move an object in a scrolling manner at a speed in proportion to a pace of that music. As to the other pieces of music, the image generating units 250 and 450 may likewise move an object in a scrolling manner at a speed with a relative difference being emphasized.

In this case, as a difference in pace of music is emphasized, a player can select music appropriate for the player even among pieces of music having similar paces.

Having described and illustrated the principles of this application by reference to preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. A selecting device which enables selection of any piece of music among plural pieces of music, the selected piece of music to be used during play of a game, the selecting device comprising:

an extracting unit which extracts a plurality of pieces of music whose identification information is to be presented;

an acquiring unit which acquires identification information and pace information for each of the extracted plurality of pieces music;

a presenting unit which displays an image corresponding to each of the extracted plurality of pieces of music and changes a display appearance of at least one of the images including contents of the acquired identification information based on the acquired pace information of the associated piece of music, thereby to present a speed of the associated piece of music; and a selecting unit which allows a player to select one of the images to select the associated piece of music to be used during play of the game.

2. A selecting device which presents identification information on each piece of music to allow a player to select music to be played among plural pieces of music, the selecting device comprising:

a music information memory unit which stores music information including identification information and pace information on each piece of music;

a selecting-out unit which selects out a predetermined number of pieces of music information each of whose identification information is to be presented from the music information memory unit;

a notification image generating unit which generates a notification image for each selected piece of music, each notification image including a predetermined indicator which changes based on the pace information of the associated piece of music;

an image display control unit which displays the notification images image; and, a selecting unit which allows a player to select one of the notification images to select the associated piece of music to be used during play of a game.

3. The selecting device according to claim 2, wherein each notification image includes:

plural kinds of indicators and a different area in the notification image is allocated to each indicator according to the kind of the indicator, and the notification image generating unit moves and displays various kinds of the indicators at a speed proportional to a pace settled by the pace information in respective areas in the notification image.

4. The selecting device according to claim 2, wherein the music information memory unit stores music information which further includes task information on each piece of the music in the game, and the notification image generating unit causes each indicator to appear based on the task information on music, and moves and displays the indicator at a speed in proportion to a pace settled by the pace information on the music in the notification image.

5. The selecting device according to claim 2, wherein the selecting unit selects any piece of the displayed identification information based on a position of a cursor, and wherein the image display control unit flashes and displays the cursor at a frequency in proportion to a pace settled by the pace information of the identification information currently selected by the selecting unit.

6. A selecting method executed by a selecting device which enables selection of any piece of music among plural pieces of music, the selected piece of music to be used during play of a game, the selecting device including an extracting unit, an acquiring unit, and a presenting unit, the selecting method comprising:

an extracting step of extracting a plurality of pieces of music whose identification information is to be presented;

an acquiring step of acquiring identification information and pace information for each of the extracted plurality of pieces of music;

a presenting step of displaying an image corresponding to each of the extracted plurality of pieces of music and changing a display appearance of at least one of the images including contents of the acquired identification information based on the acquired pace information of the associated piece of music, thereby to present a speed of the associated piece of music; and, a selecting step of allowing a player to select one of the images to select the associated piece of music to be used during play of the game.

7. A selecting method executed by a selecting device which presents identification information on each piece of music to allow a player to select music to be played among plural pieces of music, the selecting device including a music information memory unit, a selecting-out unit, a notification image generating unit, and an image display control unit, the music information memory unit storing music information including identification information and pace information on each piece of music, the selecting method comprising:

a selecting-out step of selecting out a predetermined number of pieces of the music information each of whose identification information is to be presented from the music information memory unit;

a notification image generating step of generating a notification image for each selected piece of music, each notification image including a predetermined indicator which changes based on the pace information of the associated piece of music;

an image display control step of synthesizing each image including contents of the identification information on each piece of the selected music information with each generated notification image of each piece of the selected music information and of displaying the synthesized image; and, a selecting step of allowing a player to select one of the notification images to select the associated piece of music to be used during play of a game.

8. A computer-readable information recording medium recording a program which allows a computer that enables selection of any piece of music among plural pieces of music, the selected piece of music to be used during play of a game, the computer-readable information recording medium to function as:

an extracting unit which extracts a plurality of pieces of music whose identification information is to be presented;

an acquiring unit which acquires identification information and pace information for each of the extracted plurality of pieces music;

a presenting unit which displays an image corresponding to each of the extracted plurality of pieces of music and changes a display appearance of at least one of the images including contents of the acquired identification information based on the acquired pace information of the associated piece of music, thereby to present a speed of the associated piece of music; and a selecting unit which allows a player to select one of the images to select the associated piece of music to be used during play of the game.

9. A computer-readable information recording medium recording a program which allows a computer that presents identification information on each piece of music to allow a player to select music to be played among plural pieces of music to function as:

a music information memory unit which stores music information including identification information and pace information on each piece of music;

a selecting-out unit which selects out a predetermined number of pieces of music information each of whose identification information is to be presented from the music information memory unit;

a notification image generating unit which generates a notification image for each selected piece of music, each notification image including a predetermined indicator which changes based on the pace information of the associated piece of music;

an image display control unit which displays the notification images image; and, a selecting unit which allows a player to select one of the notification images to select the associated piece of music to be used during play of a game.

* * * * *